US010760569B2

(12) United States Patent
Strelow

(10) Patent No.: US 10,760,569 B2
(45) Date of Patent: Sep. 1, 2020

(54) RECIPROCATING PUMPS AND CLOSURES THEREFORE

(71) Applicant: John L. Strelow, Broken Arrow, OK (US)

(72) Inventor: John L. Strelow, Broken Arrow, OK (US)

( * ) Notice: Subject to any disclaimer, the term of this patent is extended or adjusted under 35 U.S.C. 154(b) by 303 days.

(21) Appl. No.: 15/972,971

(22) Filed: May 7, 2018

(65) Prior Publication Data

US 2018/0340532 A1 Nov. 29, 2018

Related U.S. Application Data

(60) Provisional application No. 62/510,470, filed on May 24, 2017.

(51) Int. Cl.

| | |
|---|---|
| ***F04B 53/22*** | (2006.01) |
| ***F04B 9/02*** | (2006.01) |
| ***F04B 1/0404*** | (2020.01) |
| ***F04B 53/14*** | (2006.01) |
| ***F04B 19/22*** | (2006.01) |
| ***F04B 53/16*** | (2006.01) |

(52) U.S. Cl.

CPC ..... *F04B 53/22* (2013.01); *F04B 1/0404* (2013.01); *F04B 9/02* (2013.01); *F04B 19/22* (2013.01); *F04B 53/146* (2013.01); *F04B 53/164* (2013.01)

(58) Field of Classification Search

CPC ..... F04B 53/164; F04B 9/02; F04B 1/0404; F04B 53/146; F04B 19/22; F04B 53/22

See application file for complete search history.

(56) References Cited

U.S. PATENT DOCUMENTS

| | | | | |
|---|---|---|---|---|
| 4,875,690 | A | 10/1989 | Kennedy et al. | |
| 5,253,987 | A | 10/1993 | Harrison | |
| 6,623,259 | B1 * | 9/2003 | Blume | F04B 53/007 137/543.23 |
| 7,984,671 | B2 | 7/2011 | Jensen et al. | |
| 8,393,260 | B2 | 3/2013 | Kennedy et al. | |
| 8,616,555 | B2 | 12/2013 | Sridhar et al. | |
| 9,435,454 | B2 | 9/2016 | Blume | |
| 2006/0002806 | A1 | 1/2006 | Baxter et al. | |
| 2009/0172944 | A1 | 7/2009 | Jensen et al. | |
| 2010/0143163 | A1 | 6/2010 | Patel et al. | |
| 2011/0027106 | A1 | 2/2011 | Ochiai | |
| 2014/0086774 | A1 | 3/2014 | Chandrasekaran et al. | |
| 2016/0108910 | A1 | 4/2016 | Smith | |
| 2016/0245280 | A1 | 8/2016 | Todorov et al. | |
| 2017/0218932 | A1 * | 8/2017 | Freed | F04B 39/0094 |
| 2018/0135621 | A1 * | 5/2018 | Blume | F04B 53/16 |
| 2018/0298892 | A1 * | 10/2018 | Buckley | F04B 19/22 |

FOREIGN PATENT DOCUMENTS

| | | |
|---|---|---|
| GB | 2306607 | 7/1997 |

OTHER PUBLICATIONS

"How the High Pressure Pump Works"; www.epowerwash.com; Internet Publication; May 7, 2010; US.

PCT International Search Report and Written Opinion; PCT/US2018/031401; dated Jul. 26, 2018; U.S.

* cited by examiner

*Primary Examiner* — Abiy Teka

(74) *Attorney, Agent, or Firm* — Dennis D. Brown; Brown Patent Law, P.L.L.C.

(57) ABSTRACT

A closure for the fluid end of a reciprocating pump which uses a closure plate or assembly that is secured in a slot formed in the fluid end body so that no retaining threads must be formed in the body.

18 Claims, 12 Drawing Sheets

RECIPROCATING PUMPS AND CLOSURES THEREFORE

RELATED CASE

This application claims the benefit of U.S. Provisional Patent Application Ser. No. 62/510,470 filed on May 24, 2017 and incorporates said provisional application by reference into this document as if fully set out at this point.

FIELD OF THE INVENTION

The present invention relates to high pressure reciprocating pumps and to fluid end closures used in such pumps.

BACKGROUND OF THE INVENTION

High pressure reciprocating pumps are commonly used for high pressure oilfield applications, such as, for example, hydraulic fracturing. When such pumps are used for hydraulic fracturing, a reciprocating plunger causes the fracturing fluid to flow into and out of a fluid chamber which is formed in a "fluid end" body of the pump. As the plunger moves away from the fluid chamber, the fracturing fluid is drawn through an inlet valve into the fluid chamber. Then, when the plunger changes direction and moves toward the fluid chamber, the fracturing fluid is discharged from the pump through an outlet valve.

A high pressure reciprocating pump assembly 10 of the type heretofore used in the art is illustrated in FIGS. 1A and 1B. The pump assembly 10 can be installed in fixed position or can be mounted on a trailer or skid for moving from site to site on land or offshore. The pump assembly 10 comprises a power end 12 and a fluid end body 20. The fluid end body 20 is coupled with the power end 12 by a set of stay rods 16.

The fluid end body 20 of the pump assembly 10 can have one or a plurality of internal fluid chambers 22. For each of the internal fluid chambers 22, the fluid end body 20 comprises: a suction bore 26 through which a fluid is drawn from a suction manifold 28 into the fluid chamber 22; a suction valve 24 within the suction bore 26; a discharge access bore 32; a discharge valve 30 accessible via the discharge access bore 32; a plunger bore (cylinder) 34 in communication with the fluid chamber 22; a plunger 36 which is slidably received in the plunger bore 34 for reciprocating movement toward and away from the fluid chamber 22; and an access bore 38 which provides access to the plunger bore 34 and to the suction bore 26.

The suction bore 26 extends inwardly from a first face 25 of the fluid end body 20 to the internal fluid chamber 22. The discharge access bore 32 extends inwardly from a second face 31 of the fluid end body 20 to the internal fluid chamber 22. The plunger bore 34 extends inwardly from a third face 31 of the fluid end body 20 to the internal fluid chamber 22. The access bore 38 extends inwardly from a fourth face 37 of the fluid end body 20 to the internal fluid chamber 22.

The power end 12 of the pump assembly 10 comprises a drive assembly 13 which is contained within a power end housing 15. The drive assembly 13 comprises: a crankshaft 50; a bull gear 52 which rotates the crankshaft 50; and a pinion gear 54 which engages and drives the bull gear 52. An engine or motor (not shown) is connected or linked to the pinion gear 54 for directly or indirectly driving the pinion gear 54 during operation.

In the pump assembly 10 shown in FIG. 1, a connecting rod 56 mechanically connects the crankshaft 50 of the power end 12 to a cross head 58 via a wrist pin 60. The crosshead 58 is mounted for reciprocating linear movement within a stationary crosshead housing 62. A pony rod 64 is connected between the crosshead 58 and the plunger 36 for driving the reciprocating movement of the plunger 36 within the plunger bore (cylinder) 34 of the fluid end body 20. It will be understood, however, that the plunger 36 can alternatively be directly coupled with the crosshead 58 such that the pony rod 64 would be eliminated.

As will also be understood by those in the art, the fluid end 20 of the pump assembly 10 can have a single reciprocating plunger 36 or can have multiple plungers 36 which operate in a corresponding number of cylinders 34, depending upon the fluid flow capacity required. The reciprocating plunger pumps most commonly used for hydraulic fracturing are 3 cylinder (triplex) pumps and 5 cylinder (quintuplex) pumps.

As illustrated in FIG. 1A, each plunger 36 used in the pump assembly 10 extends through a plunger bore (cylinder) 34 of the fluid end body 20 so as to interface with a corresponding internal fluid chamber 22. As the plunger 36 moves longitudinally away from the chamber 22, the pressure inside the fluid chamber 22 decreases, thus creating a differential pressure across the suction valve 24. A biasing member 68 (e.g., a spring) located between the suction valve 24 and a valve stop 70 maintains a predetermined closing force on the suction valve 24, thereby maintaining the suction valve 24 in a closed position until the differential pressure across the suction valve 24 reaches a point which is sufficient to overcome the force generated by the biasing member 68.

When this point is reached, the suction valve 24 opens to allow the fluid to enter the fluid chamber 22 from the suction manifold 28. The fluid then continues to be drawn into the fluid chamber 22 until the pressure differential between the fluid inside the chamber 22 and the fluid pressure inside the suction manifold 28 is reduced to a point at which the suction valve 24 automatically returns to its closed position (via, e.g., the biasing mechanism 68 of the suction valve 24 and/or the pressure within the chamber 22).

As the plunger 36 then changes direction and moves longitudinally toward the fluid chamber 22, the fluid pressure inside the chamber 22 increases to produce a pressure differential across the discharge valve 30 which acts against the closing force of a biasing spring 74 to open the discharge valve 30 so that the fluid is discharged from the fluid chamber 22 of the fluid end body 20 via discharge bore 66 and a discharge port 65.

The pump assembly 10 also includes: a pressure containing closure 80 for each plunger bore 34 of the fluid end body 20; a pressure containing closure 84 for each discharge access bore 32 of the fluid end body 20; a pressure containing closure 86 for each access bore 38 of the fluid end body 20; and a pressure closure 89 for the side bore 66 of the discharge port 65. FIG. 1B also shows pressure gage connections 91 and 93 installed through the closures 84 of two of the discharge access bores 32.

Heretofore, the pressure containing closures used in the industry in the fluid end bodies of high pressure reciprocating pumps have been either (a) threaded closures of the type illustrated in FIG. 2 or (b) flanged closures with threaded studs as illustrated in FIG. 3.

When using a prior art threaded closure 90 of the type illustrated in FIG. 2 (also referred to as a threaded retainer), the threaded closure 90 will be received within the outer end of the bore 34, 32, 38 or 66 of the fluid end body 20 for closing the outer end of the bore and for holding an internal seal member 92 (e.g., a cover 97 with a surrounding O-ring or other seal element 99) in contact with a radial retaining shoulder 94 formed within the bore 34, 32, 38 or 66. The prior art threaded closure 90 includes threads 96 which are formed around the cylindrical exterior of the closure 90 and which mate with, and are received by, threads 98 which must be formed in the fluid end body 20 around the cylindrical interior wall 100 of the bore 34, 32, 38 or 66.

It is also known in the art that the threaded closure (retainer) 90 and the cover 97 can alternatively be formed together as a single element.

When using a prior art flanged pressure containing closer 102 of the type illustrated in FIG. 3 (also referred to as a flanged retainer), a cylindrical body portion 104 of the flanged closure 102 will be received within the outer end of the bore 34, 32, 38 or 66 of the fluid end body 20 for closing the outer end of the bore and for holding the internal seal member 92 (e.g., a cover 107 with an O-ring or other surrounding seal element 111) in contact with the radial retaining shoulder 94 formed within the bore 34, 32, 38 or 66. In addition, the flanged closure 102 also comprises a radial flange 106 which is provided at the outer end of the cylindrical body portion 104 and which will extend over the exterior surface 105 of the fluid end body 20 around the outer end of the bore 34, 32, 38 or 66. The flanged closure 102 is retained in closed position on the fluid end body 20 by at least 2 threaded studs 108 which extend through bores 112 provided in the radial flange 106. As shown in FIG. 3, each of the stud connections requires that a corresponding threaded bore 110 for threadedly receiving a distal portion 109 of the stud 108 must be formed in the fluid end body 20 adjacent to the outer end of the bore 34, 32, 38 or 66.

It is also know in the art that the flanged closure 102 and the cover 107 can alternatively be formed together as a single element.

Thus, the prior art threaded closure 90 and the prior art flanged closure (retainer) 102 which uses threaded studs 108 each require that attachment threads 98 or 110 for receiving the threaded closure 90 or the threaded studs 108 must be formed in the fluid end body 20 of the pump assembly 10. The threads 98 or 110 formed in the fluid end body 20 are difficult and costly to machine and costly or impossible to repair if the threads 98 or 110 are damaged during machining or assembly. In addition, the prior art threaded closures are subject to thread fatigue failures due to the highly fluctuating pressure conditions produced in high pressure reciprocating pumps.

The cost of repairing or replacing a damaged fluid end body for a 3 cylinder (triplex) or 5 cylinder (quintuplex) pump will typically be at least $1,000.00 and can be as much as $100,000.00 or more.

Also, to sufficiently tighten the prior art threaded closures 90, the closures must be hammered during assembly. This presents not only a further risk of damaging the fluid end body 20 of the reciprocating pump, but also poses a risk of injury to the workman if the correct procedure is not carefully followed.

Consequently, a need exists for improved fluid end closures for high pressure reciprocating pumps which (a) do not require the machining of attachment threads in the fluid end body, (b) do not require hammering during assembly, and (c) are less expensive to produce and install.

SUMMARY OF THE INVENTION

The present invention provides improved fluid end bodies and improved fluid end closures for high pressure reciprocating pumps which alleviate the problems and satisfy the needs discussed above. The inventive closures do not require that any retaining threads for the closures be machined or otherwise formed in the fluid end body. The inventive closures therefore also eliminate the need for hammering during assembly. In addition, because there are no threaded attachments between the inventive closures and the fluid end body, the inventive closures eliminate the possibility of a thread fatigue failure occurring during operation.

In one aspect, there is provided a closure for the fluid end body of a high pressure reciprocating pump wherein the closure comprises one or more plates or bars of any length needed to cover one or more bores in the fluid end body (e.g., to cover a single bore or to simultaneously cover a series of three bores as in a triplex pump or a series of five bores as in a quintuplex pump). The closure further comprises a mating slot which extends through or partially through the fluid end body over the outer ends of the one or more bores for slidably receiving the one or more closure plates or bars.

In another aspect, there is provided a fluid end apparatus for a reciprocating pump comprising: (a) a fluid end body having one or more bores which extend inwardly into a face of the fluid end body; (b) a closure slot which extends within the face of the fluid end body over an outer end of each of the one or more bores; (c) the closure slot having a longitudinal length which extends from a first side of the face of the fluid body to, or at least a portion of the distance to, a second side of the face which is opposite the first side, and the closure slot having an end opening in one or both of the first and the second sides of the face; (d) an outer access opening for the closure slot which extends inwardly to the closure slot from an outer surface of the face of the fluid end body and extends longitudinally with the closure slot from the first side of the face to, or at least a portion of the distance to, the second side of the face; (e) the outer access opening having a lateral width which is less than a lateral width of the closure slot but the same as or greater than a diameter of the one or more bores such that a sealing member (e.g., a cover with an O-ring or other sealing element) or other object can be placed in or removed from the outer end of each of the one or more bores via the access opening; and (f) a closure plate structure which is slidably receivable in the closure slot and has at least one width dimension which is greater than the lateral width of the outer access opening such that the closure plate structure can be placed and retained in the closure slot over the outer end of at least one of the one or more bores.

In another aspect, there is provided a fluid end apparatus for a reciprocating pump comprising: (a) a fluid end body having one or more bores which extend inwardly into a face of the fluid end body; (b) a sealing member for each of the one or more bores; (c) a closure slot which extends within the face of the fluid end body over an outer end of each of the one or more bores; (d) the closure slot having a longitudinal length which extends from a first side of the face of the fluid end body to, or at least a portion of the distance to, a second side of the face which is opposite the first side, and the closure slot having an end opening in one or both of the first and the second sides of the face; (e) an outer access opening for the closure slot which extends inwardly to the closure slot from an outer surface of the face of the fluid end body and extends longitudinally with the closure slot from the first side of the face to, or at least a portion of the distance to, the second side of the face; (f) the outer access opening having a lateral width which is the same as or greater than a diameter of the one or more bores such that the sealing member for each of the one or more bores can be placed in or removed from the outer end of each of the one or more bores via the access opening; (g) the lateral width of the outer access opening is less than a lateral width of the closure slot such that the outer access opening divides the closure slot into a longitudinally extending open central portion, a first longitudinally extending slot channel running adjacent to a first lateral side of the open central portion, and a second longitudinally extending slot channel running adjacent to a second lateral side of the open central portion which is opposite the first lateral side of the open central portion; (h) a first elongate bar which is slidably received in the first longitudinally extending slot channel over and in contact with a first outer edge portion of the sealing member; and (i) a second elongate bar which is slidably received in the second longitudinally extending slot channel over and in contact with a second outer edge portion of the sealing member.

Further aspects, features, and advantages of the present invention will be apparent to those of ordinary skill in the art upon examining the accompanying drawings and upon reading the following Detailed Description of the Preferred Embodiments.

DETAILED DESCRIPTION OF THE PREFERRED EMBODIMENTS

Figure 1A:
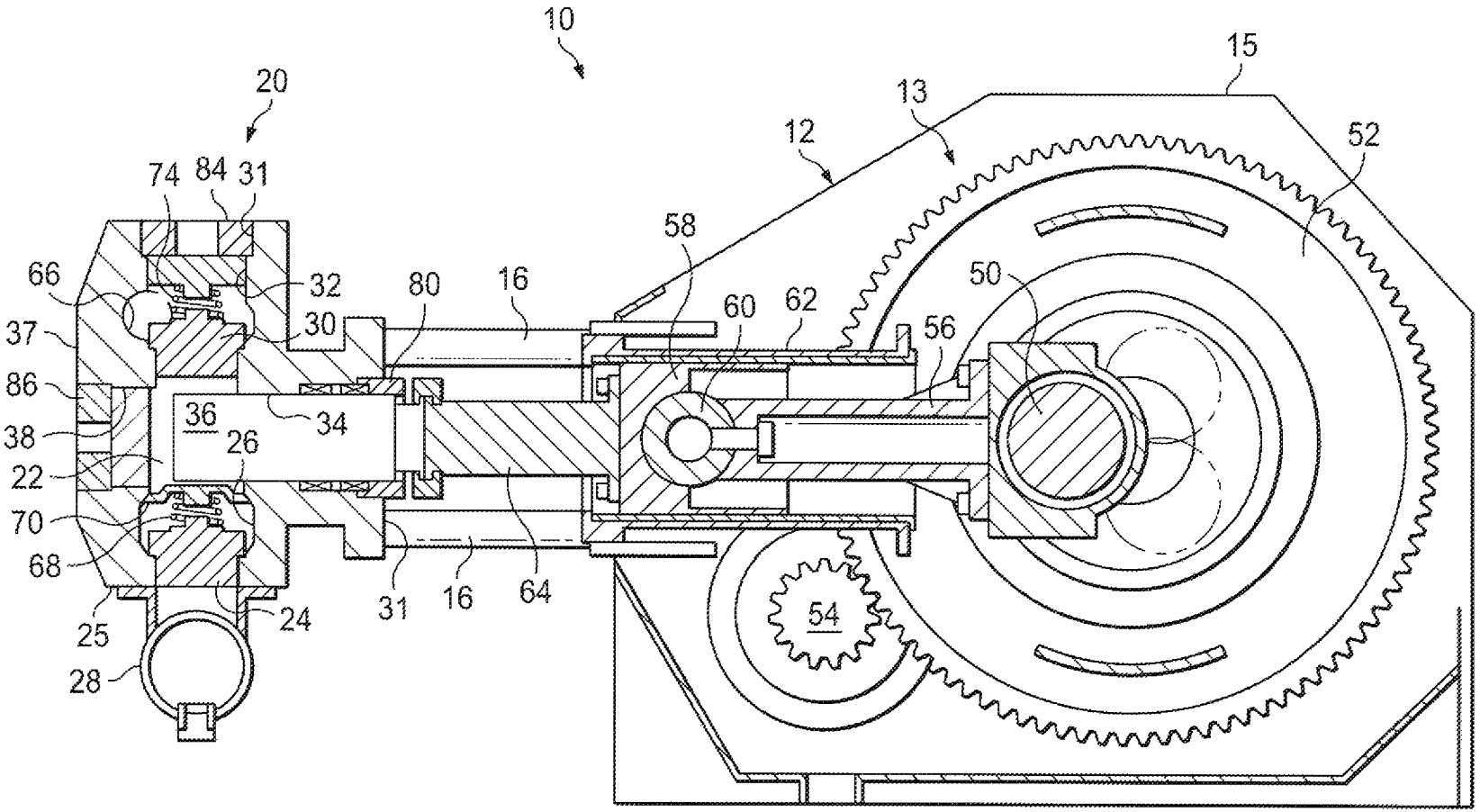
FIG. 1A (PRIOR ART)
FIG. 1A is a schematic cutaway side view of a prior art, high pressure reciprocating pump assembly 10.
Figure 1B:
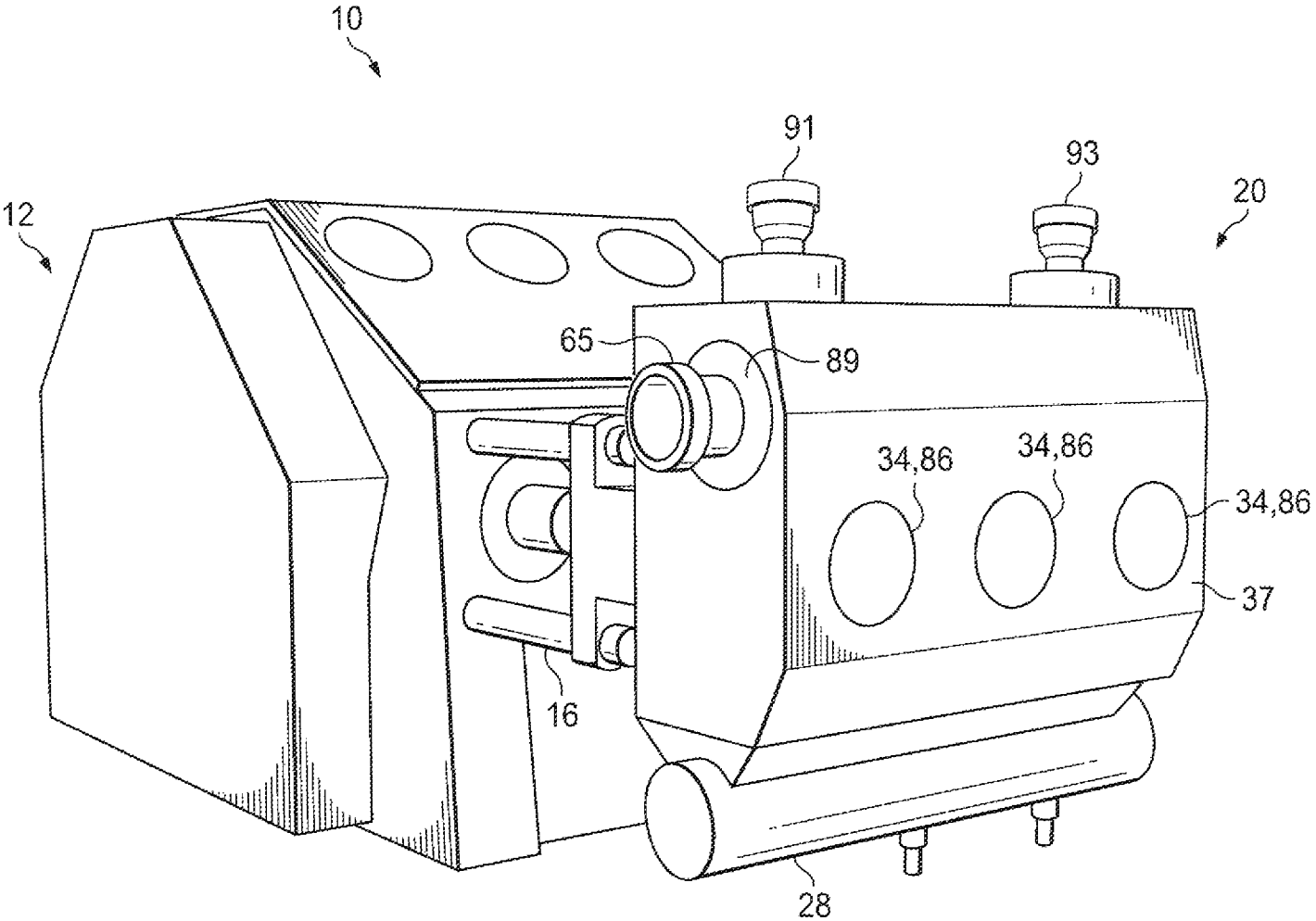
FIG. 1B (PRIOR ART)
FIG. 1B is a perspective view of the prior art, high pressure reciprocating pump assembly 10.
Figure 2:
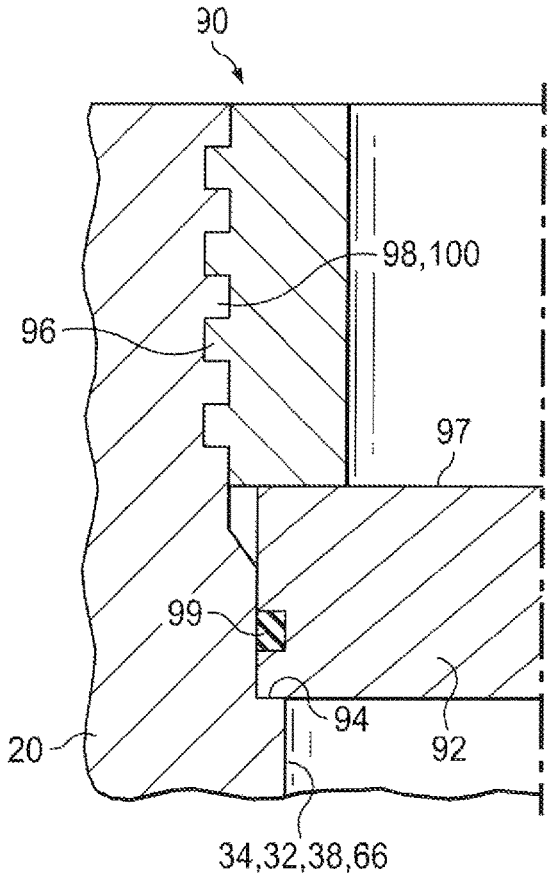
FIG. 2 (PRIOR ART)
FIG. 2 is a cutaway elevational side view of one half of a prior art threaded closure 90 used in high pressure reciprocating pump assemblies.
Figure 3:
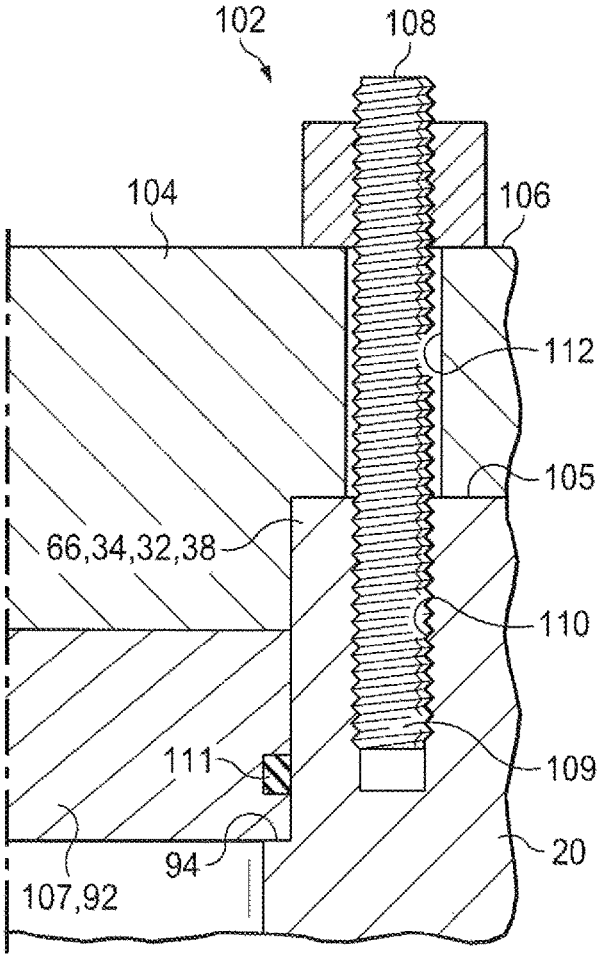
FIG. 3 (PRIOR ART)
FIG. 3 is a cutaway elevational side view of one half of a prior art flanged closure 102 used in high pressure reciprocating pump assemblies.
Figure 4:
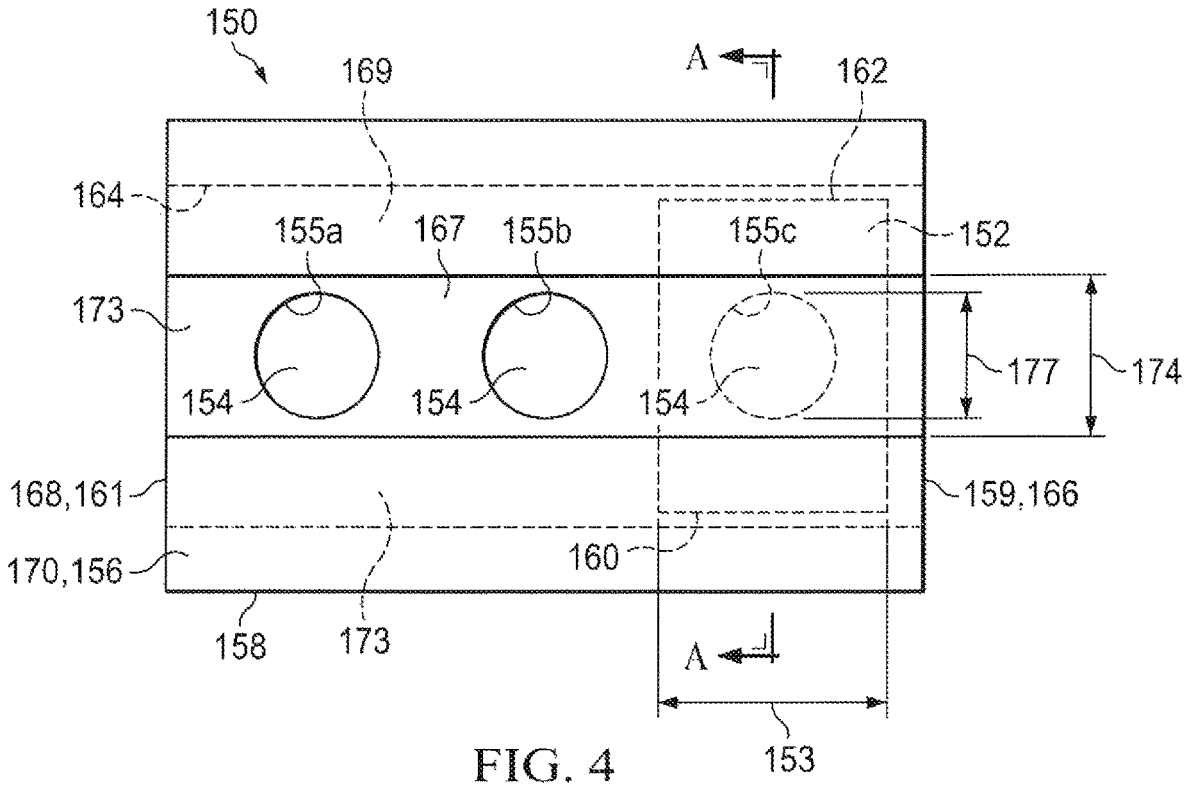
FIG. 4 is a plan view of a first embodiment 150 of the closure assembly provided by the present invention.
Figure 5:
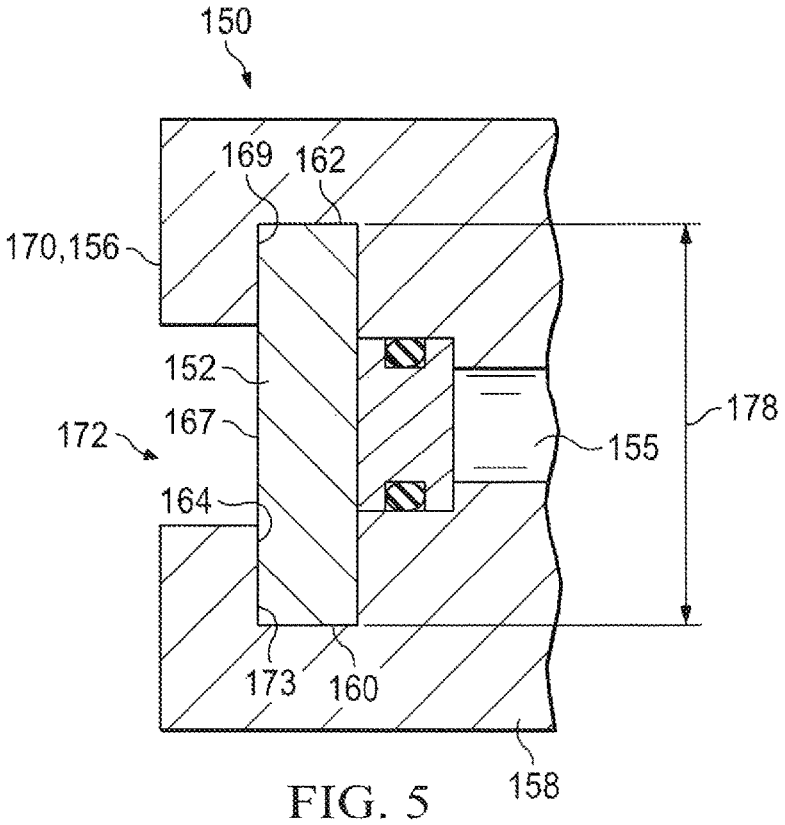
FIG. 5 is a lateral cutaway view of the inventive closure assembly 150 as seen from perspective A-A shown in FIG. 4.
Figure 7:
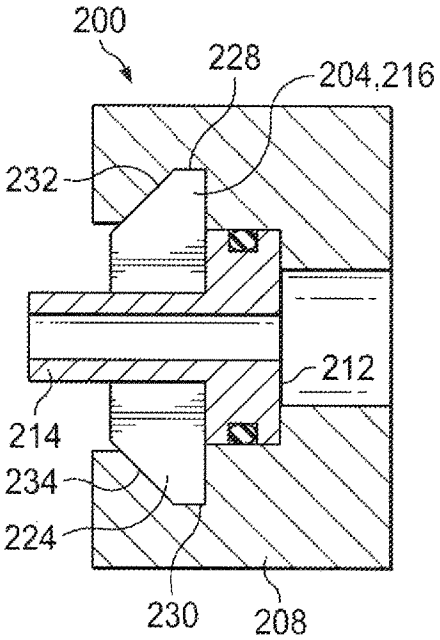
FIG. 7 is a lateral cutaway view of the inventive closure assembly 200 as seen from perspective 7-7 shown in FIG. 6.
Figure 10:
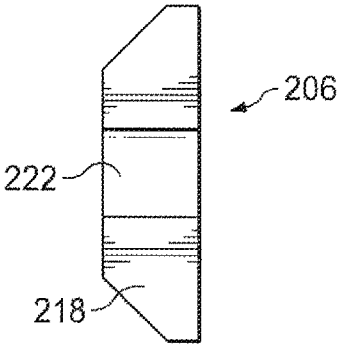
FIG. 10 is an end view of the linear half 206 of the two piece cover plate 202 used in the inventive closure assembly 200.
Figure 6:
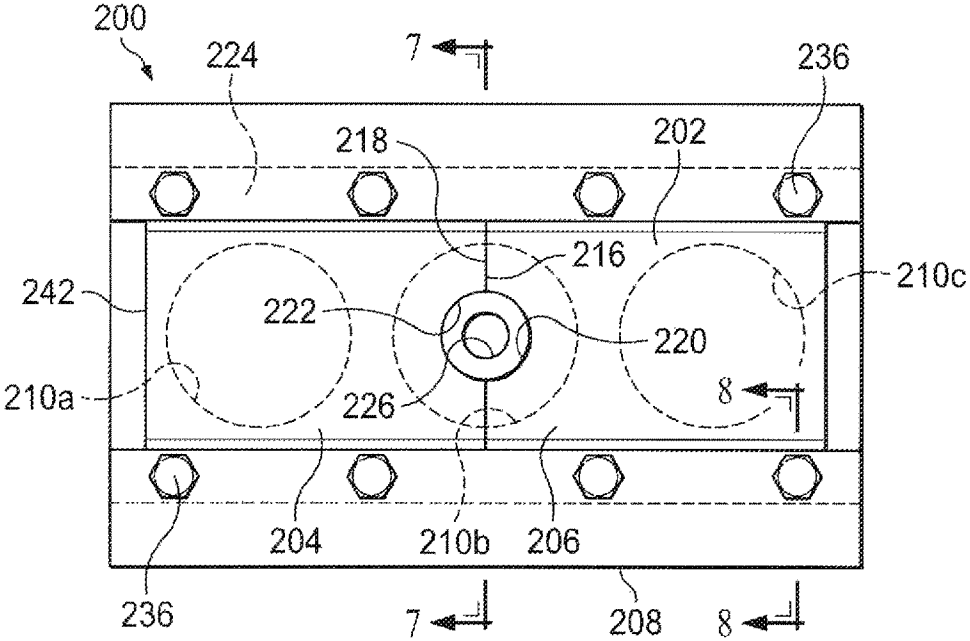
FIG. 6 is a plan view of a second embodiment 200 of the closure assembly provided by the present invention.
Figure 9:
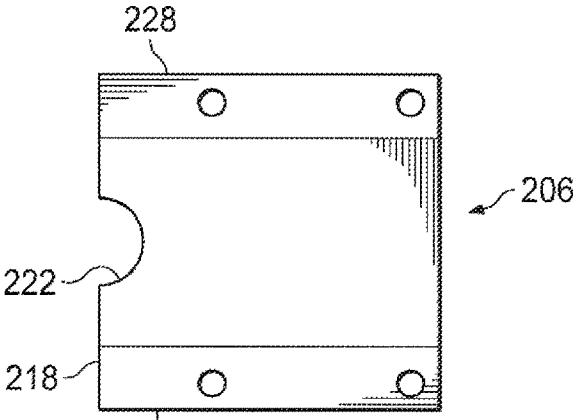
FIG. 9 is a plan view of a linear half 206 of a two piece cover plate 202 used in the inventive closure assembly 200.
Figure 8:
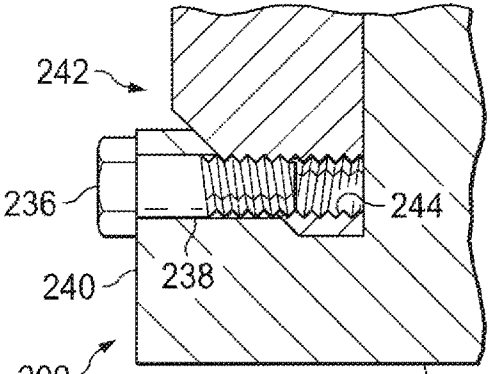
FIG. 8 is a cutaway view of the inventive closure assembly 200 as seen from perspective 8-8 shown in FIG. 6.

A first embodiment 150 of the inventive closure assembly is illustrated in FIGS. 4 and 5. The inventive closure assembly 150 comprises a cover plate 152 having a longitudinal length 153 which is sufficient to cover the outer end opening 154 of at least one bore 155, or to cover the outer end openings 154 of a series of two, three, or more bores 155*a*, 155*b*, and/or 155*c*, which are provided in one face 156 of the fluid end body 158 of a high pressure reciprocating pump. The longitudinally extending lateral sides 160 and 162 of the cover plate 152 are preferably linear and can have a rectangular cross-sectional shape as indicated in FIG. 5 or can be beveled or rounded or can have other cross-sectional shapes. In addition, the cross-sectional shapes of the longitudinally extending lateral sides 160 and 162 of the cover plate 152 can be the same (e.g., both squared) or different (e.g., one squared and one beveled).

It will be understood that, unless otherwise specified, the term "plate" as used in reference to element 152, or in reference to other elements described herein, is an inclusive term covering structures of the type shown or described, regardless of whether the element was cut from or formed as a metal plate, cut from or formed as a metal bar, or cut or formed in any other manner from any desired material.

The cover plate 152 is slidably received in a cover plate slot 164 which is formed within the face 156 of the fluid end body 158 over, and preferably perpendicular to, the outer end openings 154 of the bore(s) 155 or 155*a*, 155*b*, and 155*c*. By way of example, but not by way of limitation, the slot 164 for the cover plate 152 can be formed in the fluid end body 158 by standard machining processes such as milling.

As seen in FIG. 5, the lateral cross-sectional shape of the cover plate slot 164 preferably corresponds to the lateral cross-sectional shape of the cover plate 152. In addition, the slot 164 preferably has a longitudinal length which extends within the face 156 of the fluid end body 158 from one side 159 of the face 156 to the other side 161 so that the corresponding longitudinal ends 166 and 168 of the slot 164 are open for slidably receiving the cover plate 152. Once inserted into either of the longitudinal ends 166 or 168 of the slot 164, the cover plate 152 can be moved into a closing position over one or more of the bore openings 154.

Alternatively, it will be understood that the cover plate slot 164 can be milled or otherwise formed such that the slot 164 does not extend the entire distance from side 159 to the other side 161 of the face 156 of the fluid end body 158 but instead has a closed end. The closed end will preferably be located between side 161 of the face 156 and the bore 155*a* which is closest to the side 161.

The cover plate slot 164 is spaced inwardly below, and runs parallel to, the outer surface 170 of the face 156 of the fluid end body 158. However, a centralized, longitudinally extending outer access opening 172 for the slot 164 extends inwardly from the outer surface 170 of the face 156 of the fluid end body 158 to the slot 164. The lateral width 174 of the outer access opening 172 is the same as or preferably slightly greater than the diameter 177 of the outer end openings 154 of the bore(s) 155 or 155*a*, 155*b*, 155*c* so that sealing members 176 can be inserted through the outer access opening 172 into the bore(s) 155 or 155*a*, 155*b*, 155*c*.

However, the lateral width 174 of the outer access opening 172 is less than the lateral width 178 of the slot 164 and is also less than the lateral width of the cover plate 154. As a result, the longitudinally extending outer access opening 172 divides the longitudinally extending slot 164 into (a) a longitudinally extending open central portion 167, (b) a first longitudinally extending slot channel 169 running adjacent to one lateral side of the open central portion 167, and (c) a second longitudinally extending slot channel 173 adjacent the opposite lateral side of the open central portion 167. The longitudinally extending slot channels 169 and 173 extend longitudinally within the face 156 of the fluid end body 158 either (a) from one side 159 of the face 156 to the other side 161 such that both ends of each of the slot channels 169 and 173 are open or (b) at least a portion of the distance from side 159 to side 161 such that the slot channels 169 and 173 each have a closed end, which will preferably be located between side 161 and bore 155*a*. The slot channels 169 and 173 slidably receive and retain the longitudinally extending lateral side edges 160 and 162 of the cover plate 152.

Figure 24:
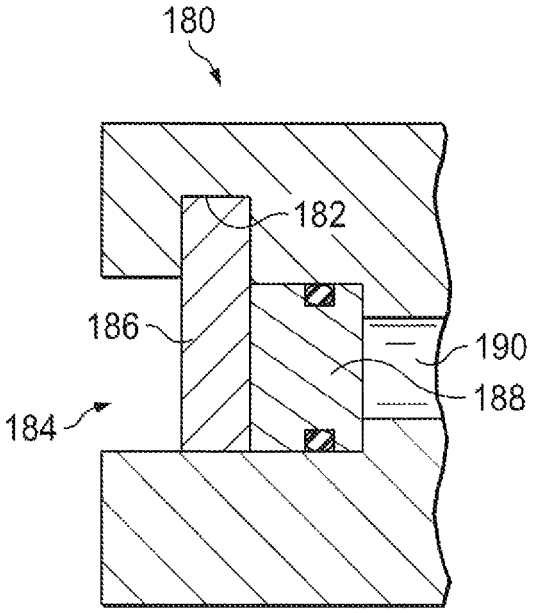
FIG. 24 is a cutaway view of an embodiment 180 of the inventive closure assembly which is a variation of the embodiment 150 illustrated in FIGS. 4 and 5.

A variation 180 of the closure plate assembly 150 is illustrated in FIG. 24. In the assembly 180, a slot channel 182 is milled or otherwise formed along only one lateral side of the longitudinally extending access opening 184. In this variation 180, the lateral depth of the slot channel 182 and the milling tolerances used for forming the slot channel 182 and the cover plate 186 prevent the cover plate 186 from the pivoting in the slot channel 182 so that that the cover plate 186 and the sealing member 188 are firmly retained in the bore 190.

By way of example, but not by way of limitation, the inventive closure assemblies 150 and 180 can be used for closing the access bores, discharge bores, or valve cover bores of the fluid end body 158.

A second embodiment 200 of the inventive closure assembly is illustrated in FIGS. 6-10. The inventive closure assembly 200 is similar to the inventive closure assembly 150 shown in FIGS. 4 and 5 except that the cover plate 202 of the inventive closure 200 is a two piece cover plate having a first linear half 204 and a mating second linear half 206. The two piece cover plate 202 can be used, for example, for covering a single bore opening in the fluid end body 208, or for covering the center bore 210*b* of a series of bores 210*a*, 210*b*, and 210*c*, wherein the single bore or the central bore 210*b* of the series of bores includes, for example, a sealing element 212 having a seal piece extension 214 which must project from the attached closure assembly 200 for attaching a pressure gage or for attaching any other instrument, element or structure. The mating ends 216 and 218 of the first and second linear halves 204 and 206 of the two piece cover plate 202 have corresponding cavities 220 and 222 formed therein which, when assembled in the cover plate slot 224 of the fluid end body 208 over the bore(s) 210*a*, 210*b*, and/or 210*c*, form an aperture 226 having a circular shape or other shape suitable for retaining the seal piece extension 214.

In addition to being useful, for example, for closing a single access bore having a seal piece extension 214, or for closing a series of bores wherein a central one of the bores has a seal piece extension 214, the inventive closure assembly 200 can also be used for closing a single bore or a series of bores wherein the single bore or a central one of the series of bores has, for example, a union fitting or other fitting projecting therefrom for attaching a flow line.

The longitudinally extending lateral side edges 228 and 230 of the mating first and second linear halves 204 and 206 of the two piece cover plate 202 shown in FIGS. 6-10 have beveled outer surfaces 232 and 234. However, as with the cover plate 152 of the closure assembly 150 shown in FIGS. 4 and 5, the side edge portions 228 and 230 of the two piece cover plate 202 can be rectangular or can have other lateral cross-sectional shapes.

The illustration of the inventive two piece cover plate assembly 200 in FIGS. 6-10 also differs from the illustration of the one piece cover plate assembly 150 shown in FIGS. 4 and 5 in that one or more, preferably a plurality, of bolts 236 may be used to secure each of the mating linear halves 204 and 206 of the two piece cover plate 202 in the cover plate slot 224. In each of the bolt attachments, the bolt 236 is inserted through a non-threaded bore 238 which extends into the face 240 of the fluid end body 208 outside of the centralized outer linear access opening 242 and is threadedly received and tightened in a threaded bore 244 which is provided in one of the longitudinally extending lateral side edge portions 228 or 230 of the linear half 204 or 206 of the two piece cover plate 202.

Figure 25:
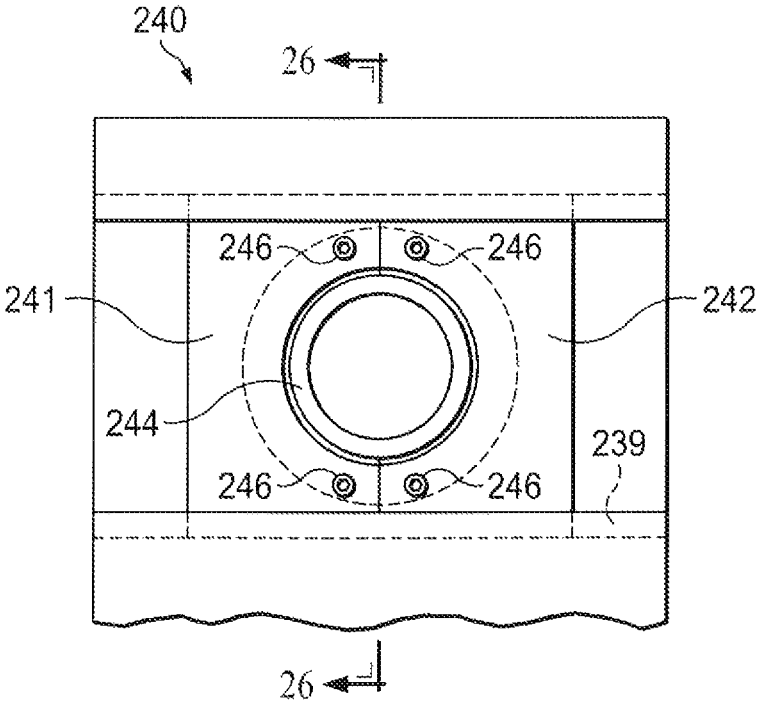
FIG. 25 is a plan view of an embodiment 240 of the inventive closure assembly which is a variation of the embodiment 200 illustrated in FIGS. 6-10.
Figure 26:
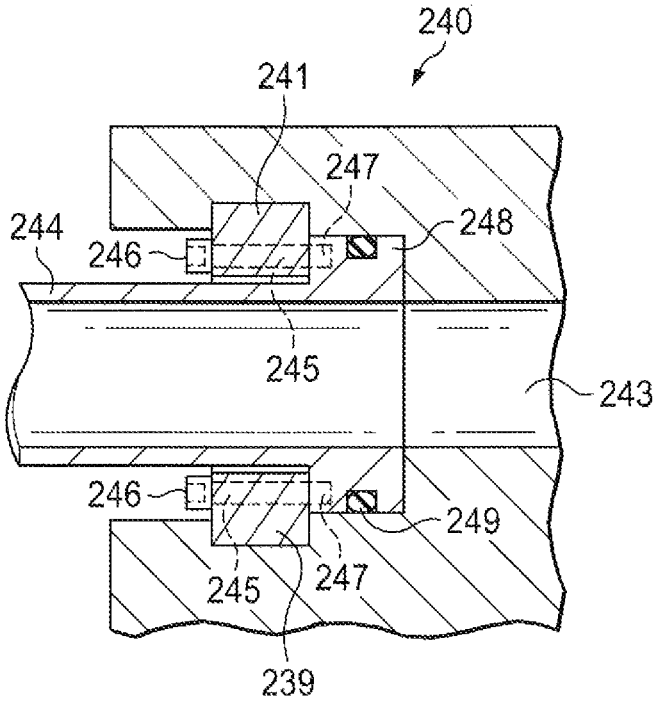
FIG. 26 is a cutaway view of the inventive closure assembly 240 as seen from perspective 26-26 shown in FIG. 25.

A variation 240 of the closure assembly 200 for covering a single bore 243 is illustrated in FIGS. 25 and 26. Variation 240 comprises a two piece cover having mating halves 241 and 242 sized to cover a single bore 243 having, e.g., a union fitting 244 or other fitting projecting therefrom for attaching a flow line, a seal piece projecting therefrom for attaching a pressure gage, or other structure projecting therefrom. A further variation of the closure assembly 240 is that the assembly 240 is secured in the slot 239 over the bore 243 using a plurality of bolts 246 (preferably 2 bolts 246 per each half 241 and 242 of the cover) which extend through non-threaded bores 245 provide through the halves 241 and 242 of the cover and are threadedly received and tightened in corresponding threaded bores 247 formed in a radial flange 248 provided at the base of the union fitting 244. An O-ring or other sealing element 249 is also provided around the flange 248 of the union fitting 244 for sealing the bore 243.

Figure 12:
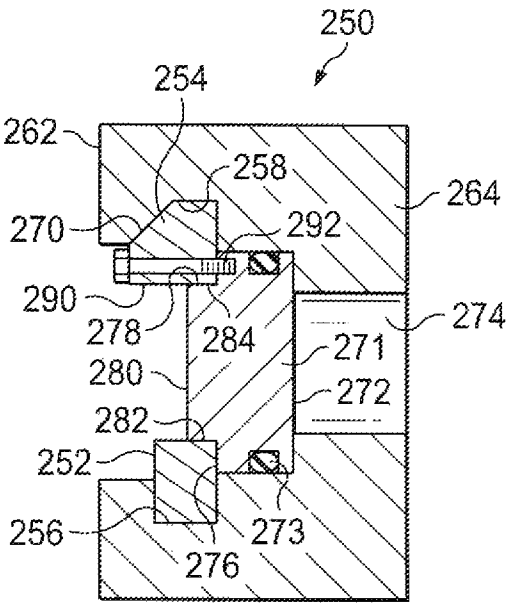
FIG. 12 is a lateral cutaway view of the inventive closure assembly 250 as seen from perspective 12-12 shown in FIG. 11.
Figure 11:
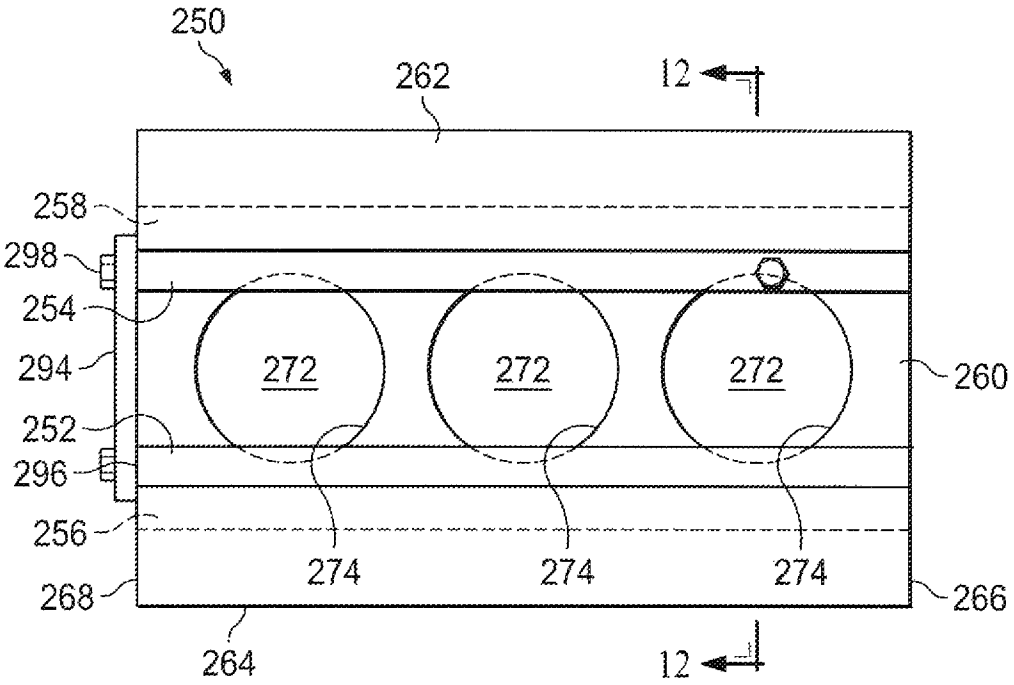
FIG. 11 is a plan view of a third embodiment 250 of the closure assembly provided by the present invention.
Figure 13:
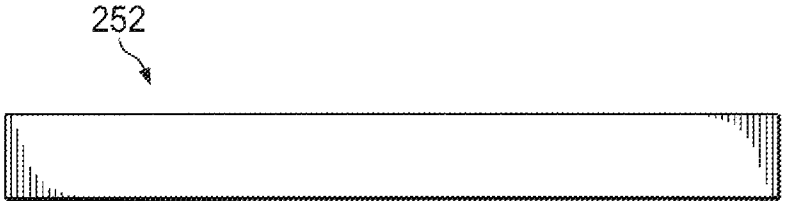
FIG. 13 is a side view of a closure bar 252 used in the inventive closure assembly 250.
Figure 14:
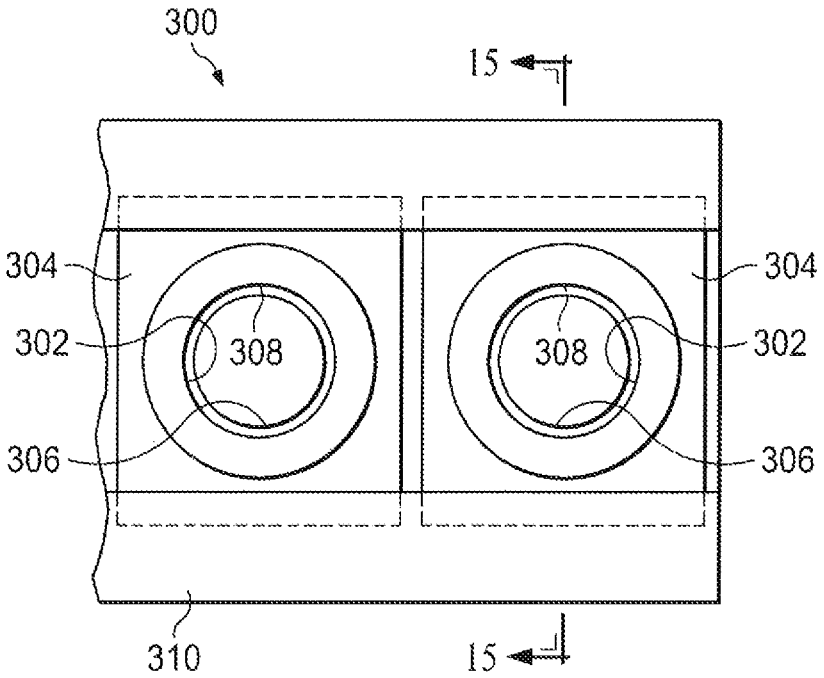
FIG. 14 is a plan view of a fourth embodiment 300 of the closure assembly provided by the present invention.

A third embodiment 250 of the inventive closure assembly is illustrated in FIGS. 11-13. The inventive closure assembly 250 is similar to the inventive closure assembly 150 shown in FIGS. 4 and 5 except that, rather than using a cover plate 152, the inventive closure assembly 250 uses a pair of longitudinally extending closure bars 252 and 254 which are slidably received in the laterally opposing side channels 256 and 258 of the cover slot 260. The slot channels 256 and 258 extend longitudinally within the face 262 of the fluid end body 264 from one side 266 of the face 262 to, or at least a portion of the distance to, the other side 268 thereof such that the ends of the slot channels 256 and 258 at or approaching the side 268 of the face 262 can be open or closed.

The cross sectional shape of each channel 256 and 258 corresponds or substantially corresponds to the cross-sectional shape of the closure bar 252 or 254 or is otherwise suitably shaped for receiving the closure bar 252 or 254 therein. The cross-sectional shapes of the bars 252 and 254 can be the same or different. In the embodiment 250 illustrated in FIGS. 11-13, the closure bar 252 is entirely rectangular whereas the closure bar 254 has a greater thickness and also has a beveled outer surface 270.

In the assembly 250, the sealing member(s) 272 illustrated in FIG. 12 each comprise a cover element 271 which is surrounded by an O-ring or other sealing element 273 for sealing the bore(s) 274. The sealing members 272 can differ from the sealing members 176 used in the assembly 150 in that side notches 276 and 278 can optionally be formed in the outer end 280 of the cover element 271 for receiving the side edges 282 and 284 of the closure bars 252 and 254 so that (a) the closure bars 252 and 254 prevent the sealing member 272 from rotating in the fluid end bore 274 and (b) the notched sealing member 272 also assists in holding the closure bars 252 and 254 in the longitudinally extending slot channels 256 and 258.

To further secure the components of the closure assembly 250 in operating position, the closure bar 254 is preferably bolted to the sealing member 272 using a bolt 288 which extends through a bore 290 formed through the closure bar 254 and is threadedly received and tightened in a corresponding threaded bore 292 provided in the outer end 280 of the sealing member 272. In addition, a lateral holding plate 294 can also be bolted to the longitudinal ends 296 and 298 of the closure bars 252 and 254. Preferably, a similar holding plate will also be bolted to the opposite ends of the closure bars 252 and 254 unless the opposite ends of the slot channels 256 and 258 are blind.

By way of example, but not by way of limitation, the inventive closure assembly 250 can be used for closing the access bores, discharge bores, or valve cover bores of the fluid end body 264.

Figure 15:
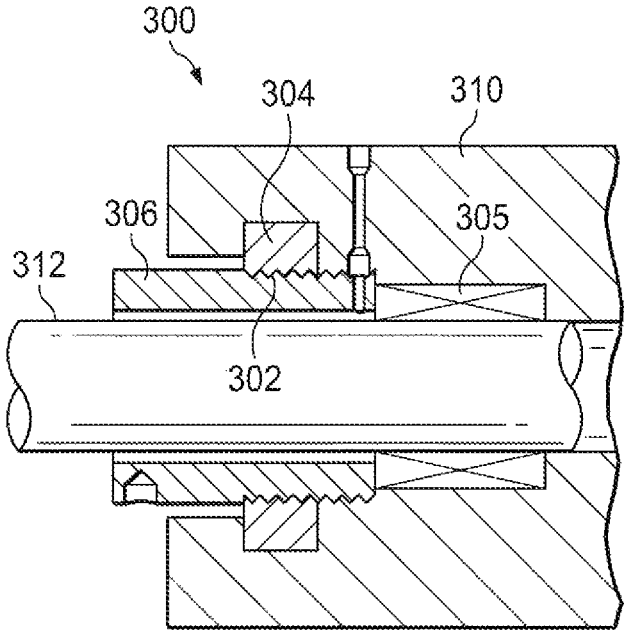
FIG. 15 is a lateral cutaway view of the inventive closure assembly 300 as seen from perspective 15-15 shown in FIG. 14.
Figure 16:
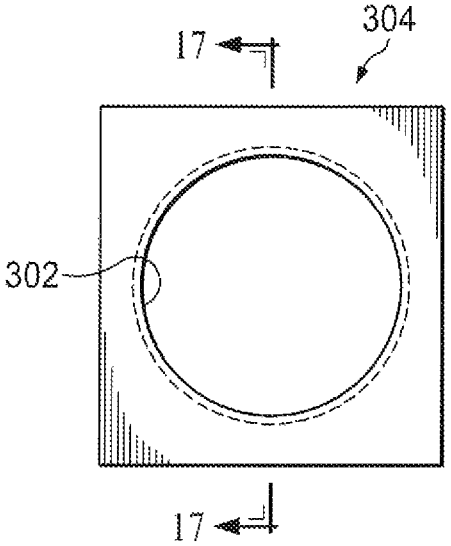
FIG. 16 is a plan view of a cover plate 304 used in the inventive closure assembly 300.
Figure 17:
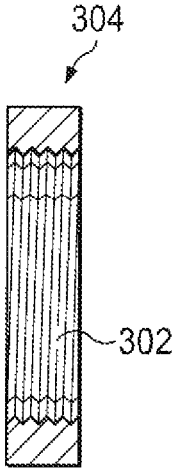
FIG. 17 is a cutaway view of the cover plate 304 as seen from perspective 17-17 shown in FIG. 16.

A fourth embodiment 300 of the inventive closure assembly is illustrated in FIGS. 14-17. The inventive closure assembly 300 is essentially the same as the inventive closure assembly 150 illustrated in FIGS. 4 and 5 except that a threaded cylindrical bore 302 is provided through the rectangular cover plate 304 of the closure assembly 300. By way of example, as shown in FIG. 15, the threaded bore 302 provided through the cover plate 304 allows a gland nut 306 or other element of a plunger stuffing box assembly to be threadedly installed in the cover plate 304 against one or more packing seal components 305. Consequently, the closure assembly 300 can be used in a plunger bore 308 of the fluid end body 310 for receiving and allowing the reciprocating pumping movement of the plunger 312 through the cover plate 304.

Figure 18:
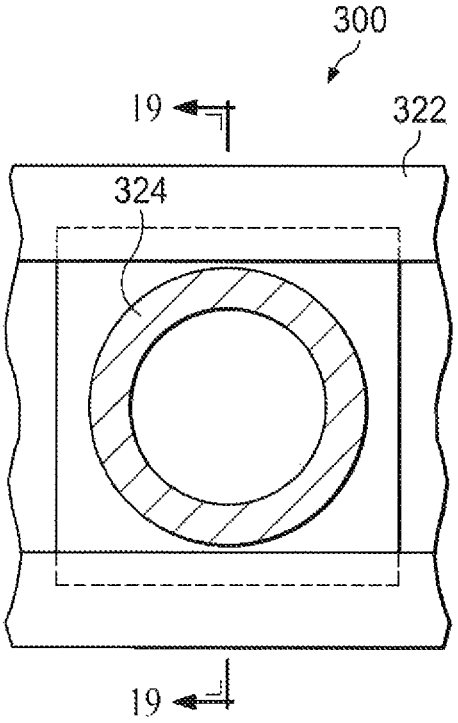
FIG. 18 is another plan view of the inventive closure assembly 300 as seen from perspective 18-18 shown in FIG. 19.
Figure 19:
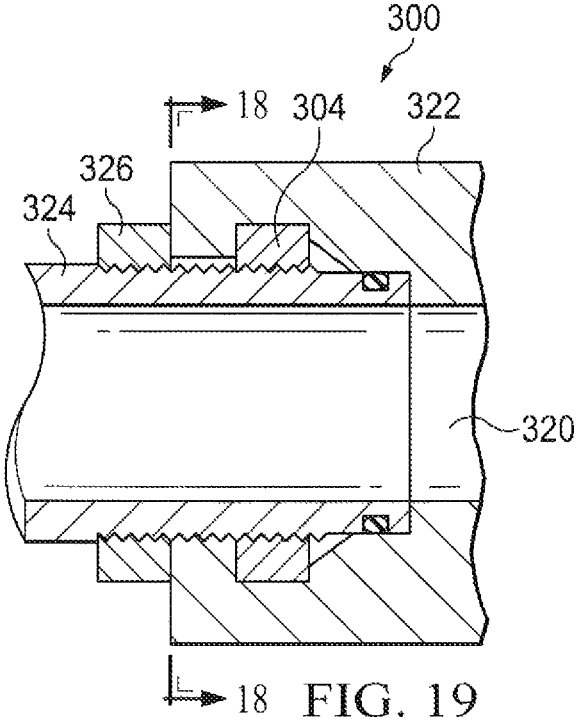
FIG. 19 is a lateral cutaway view of the inventive closure assembly 300 as seen from perspective 19-19 shown in FIG. 18.
Figure 20:
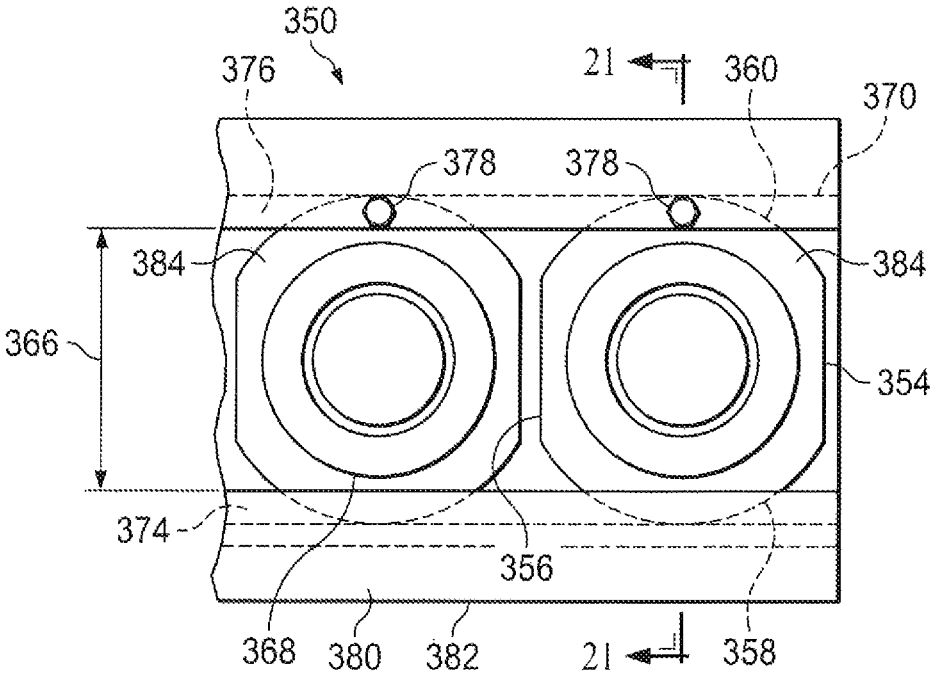
FIG. 20 is a plan view of a fifth embodiment 350 of the closure assembly provided by the present invention.
Figure 21:
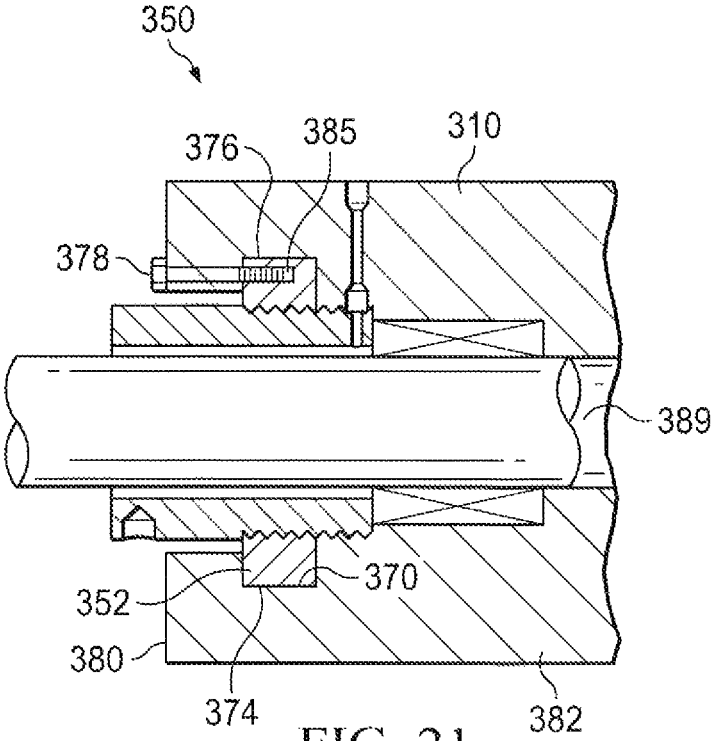
FIG. 21 is a lateral cutaway view of the inventive closure assembly 350 as seen from perspective 21-21 shown in FIG. 20.
Figure 22:
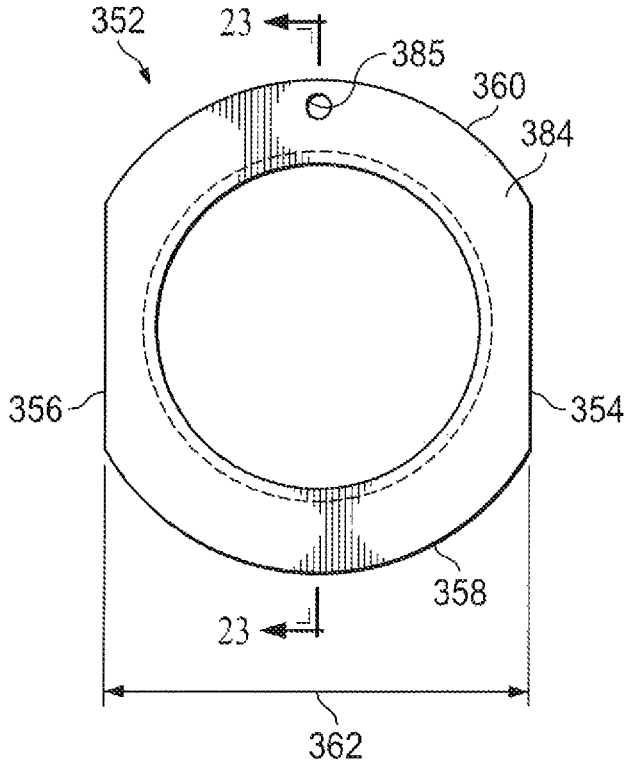
FIG. 22 is a plan view of a cover plate 352 used in the inventive closure assembly 350.
Figure 23:
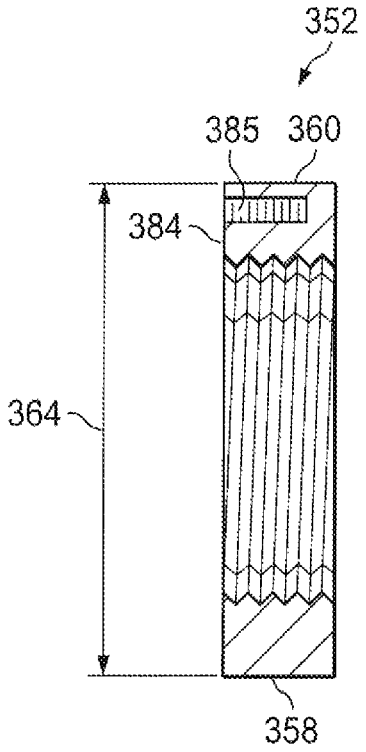
FIG. 23 is a cutaway view of the cover plate 352 as seen from perspective 23-23 shown in FIG. 22.

In addition to being used for closing a plunger bore 308, the inventive closure assembly 300 can also be used as illustrated in FIGS. 18 and 19, for example, in a discharge bore 320 of the fluid end body 322 for threadedly receiving a union fitting 324 for attaching a discharge flow line (e.g., a high pressure flow line to a well head). The closure assembly 300 illustrated in FIG. 19 also optionally includes a locking nut 326 on the fitting 324.

A fifth embodiment 350 of the inventive closure assembly is illustrated in FIGS. 20-23. The inventive closure assembly 350 is essentially the same as the inventive closure assembly 300 illustrated in FIGS. 14-19 except that, rather than being rectangular, the cover plate 352 of the closure assembly 350 has an opposing pair of flat sides 354 and 356 and an opposing pair of rounded, preferably semicircular, sides 358 and 360 wherein (a) the width 362 of the cover plate 352 between the flat sides 354 and 356 is less than the width 364 of the cover plate 352 between the rounded sides 358 and 360 and (b) the width 362 of the cover plate 352 between the flat sides 354 and 356 is also less than the lateral width 366 of the longitudinally extending access opening 368 of the cover retaining slot 370. This allows the partially rounded cover plate 352 to be inserted through the slot access opening 368 onto the bore and then rotated such that the rounded sides 358 and 360 are received in the outer, longitudinally extending channels 374 and 376 of the slot 370.

In this embodiment 350, the cover retaining slot 370 in the face 380 of the fluid end body 382 preferably extends across the outer openings of all of the bores 389 in the face 380; however, the cover retaining slot can be open at both ends, open on one end and closed on the other, or closed at both ends.

To prevent the partially rounded cover plate 352 from rotating during operation, the rounded cover plate 352 is preferably bolted in place using a bolt 378 which (a) extends through a non-threaded bore 372 in the face 380 of the fluid end body 382 outside of the longitudinally extending access opening 368 and (b) is threadedly received and tightened in a threaded bore 385 which extends into the outer surface 384 of the rounded side portion 360 of the partially rounded cover plate 352.

Figure 27:
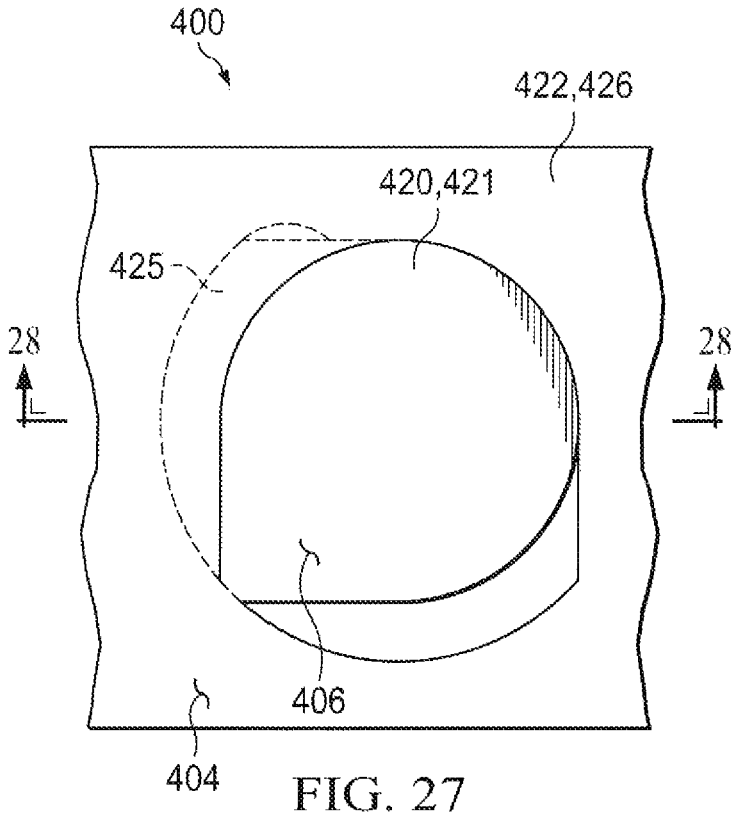
FIG. 27 is a plan view of an embodiment 400 of the inventive closure assembly.
Figure 28:
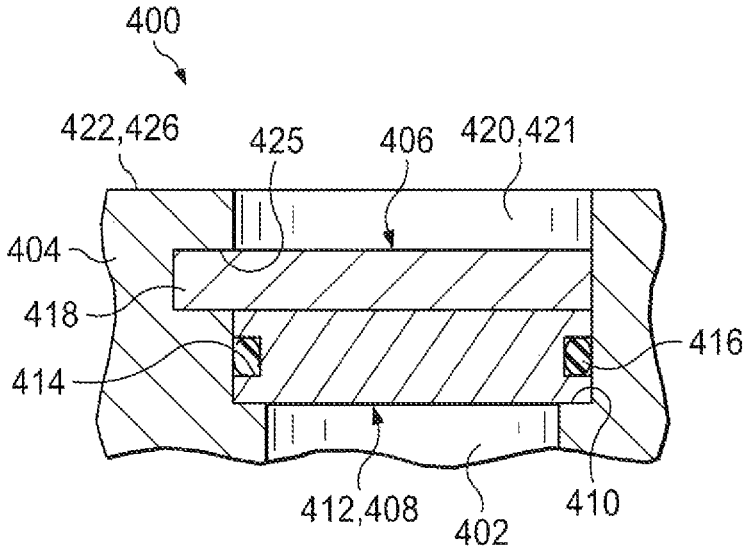
FIG. 28 is a cutaway view of the inventive closure assembly 400 as seen from perspective 28-28 shown in FIG. 27.

A sixth embodiment 400 of the inventive closure assembly for closing a single bore 402 in a fluid end body 404 is illustrated in FIGS. 27 and 28. The assembly 400 comprises a lobed pressure closure element 406 which is removably securable for retaining a sealing member 408 between the lobed element 406 and an interior radial shoulder 410 in the outer end of the bore 402.

By way of example, but not by way of limitation, the sealing member 408 can comprise a cover body 412 having a surrounding seal element groove 414 formed therein in which an O-ring or other sealing element 416 is received. Alternatively, it will be understood that the lobed closure element 406 and the cover body 412 can be formed together as a single closure and sealing element.

The lobed closure element 406 is preferably substantially circular except for a single lobed portion 418 which projects radially outward on only one side of the closure element 406.

A cavity 420 having an outer opening 421 with a shape corresponding to the shape of the lobed closure element 406 is provided in the face 422 of the fluid end body 404 for receiving the sealing member 408 and the lobed closure element 406. The cavity 420 further includes a radially projecting lobe channel 425 provided on one side of the cavity 420 beneath the outer surface 426 of the face 422 of the fluid end body 404.

Consequently, the closure element 406 can be inserted through the outer opening 421 of the cavity 422 over the sealing member 408 and then rotated so that the projecting lobe 418 of the closure 406 is received in the lobe channel 425 of the cavity 420 to thereby lock the closure 406 and sealing member 408 in place.

Thus, the present invention is well adapted to carry out the objects and attain the ends and advantages mentioned above as well as those inherent therein. While presently preferred embodiments have been described for purposes of this disclosure, numerous changes and modifications will be apparent to those in the art.

What is claimed is:

1. A fluid end apparatus for a reciprocating pump comprising:

a fluid end body having one or more bores which extend inwardly into a face of the fluid end body;

a closure slot which extends within the face of the fluid end body over an outer end of each of the one or more bores;

the closure slot having a longitudinal length which extends between a first side of the face of the fluid end body and a second side of the face which is opposite the first side and the closure slot having an end opening in one or both of the first and the second sides of the face;

an outer access opening for the closure slot which extends inwardly to the closure slot from an outer surface of the face of the fluid end body and extends longitudinally with the closure slot between the first side of the face and the second side of the face, the outer access opening having a lateral width which is (i) less than a lateral width of the closure slot but (ii) the same as or greater than a diameter of the one or more bores such that a sealing element or other object can be placed in or removed from the outer end of each of the one or more bores via the access opening; and a closure plate structure which is slideably receivable in the closure slot and has at least one width dimension which is greater than the lateral width of the outer access opening such that the closure plate structure can be placed and retained in the closure slot over the outer end of at least one of the one or more bores.

2. The fluid end apparatus of claim 1 wherein the closure plate structure is a single piece element which covers the outer ends of at least two of the one or more bores.

3. The fluid end apparatus of claim 1 further comprising a projecting structure which projects from the outer end of one of the one or more bores, wherein the closure plate structure has an aperture extending therethrough through which the projecting structure is received.

4. The fluid end apparatus of claim 3 wherein the projecting structure is a reciprocating plunger.

5. The fluid end apparatus of claim 4 wherein the aperture of the closure plate structure is threaded.

6. The fluid end apparatus of claim 5 further comprising a plunger stuffing box element which is threadedly received in the aperture of the closure plate structure, and the reciprocating plunger is slideably received through the plunger stuffing box element.

7. The fluid end apparatus of claim 3 wherein the projecting structure is a union fitting.

8. The fluid end apparatus of claim 1 wherein the closure plate structure comprises another width dimension which is less than the lateral width of the outer access opening.

9. The fluid end apparatus of claim 1 further comprising a projecting structure which projects from the outer end of one of the one or more bores, wherein the closure plate structure comprises a first plate element having a left longitudinal end and a second plate element having a right longitudinal end, the left longitudinal end of the first plate and the right longitudinal end of the second plate each have a cavity formed therein, and the first and the second plate elements are placed in the closure slot such that (i) the left longitudinal end of the first plate contacts the right longitudinal end of the second plate and (ii) the cavities formed in the left longitudinal end of the first plate and the right longitudinal end of the second plated together form an aperture through which the projecting structure is received.

10. The fluid end apparatus of claim 9 wherein the projecting structure is a seal piece extension.

11. The fluid end apparatus of claim 1 further comprising:

a non-threaded bore in the fluid end body which is positioned outside of the outer access opening and extends into the face of the fluid end body to the closure slot;

a threaded bore in the closure plate structure for alignment with the non-threaded bore in the fluid end body, and a bolt which extends through the non-threaded bore of the fluid end body and has a threaded distal end portion which is threadedly received in the threaded bore of the closure plate structure.

12. A fluid end apparatus for a reciprocating pump comprising:

a fluid end body having one or more bores which extend inwardly into a face of the fluid end body;

a sealing element for each of the one or more bores;

a closure slot which extends within the face of the fluid end body over an outer end of each of the one or more bores;

the closure slot having a longitudinal length which extends between a first side of the face of the fluid end body and a second side of the face which is opposite the first side and the closure slot having an end opening in one or both of the first and the second sides of the face;

an outer access opening for the closure slot which extends inwardly to the closure slot from an outer surface of the face of the fluid end body and extends longitudinally with the closure slot between the first side of the face and the second side of the face, the outer access opening having a lateral width which is the same as or greater than a diameter of the one or more bores such that the sealing element for each of the one or more bores can be placed in or removed from the outer end of each of the one or more bores via the access opening;

the lateral width of the outer access opening is less than a lateral width of the closure slot such that the outer access opening divides the closure slot into a longitudinally extending open central portion, a first longitudinally extending slot channel running adjacent to a first lateral side of the open central portion, and a second longitudinally extending slot channel running adjacent to a second lateral side of the open central portion which is opposite the first lateral side of the open central channel;

a first elongate bar which is slideably received in the first longitudinally extending slot channel over and in contact with a first outer edge portion of the sealing element; and a second elongate bar which is slideably received in the second longitudinally extending slot channel over and in contact with a second outer edge portion of the sealing element.

13. The fluid end apparatus of claim 12 wherein at least one of the first and the second elongate bars has a rectangular cross-sectional shape.

14. The fluid end apparatus of claim 12 wherein the first edge portion of the sealing element includes a notch in which an elongate edge of the first elongate bar is slideably received.

15. The fluid end apparatus of claim 14 wherein the second edge portion of the sealing element includes a notch in which an elongate edge of the second elongate bar is slideably received.

16. The fluid end apparatus of claim 1 further comprising:

a bore which extends laterally through the first elongate bar;

a threaded bore in the sealing element of one of the one or more bores of the fluid end body for alignment with the bore which extends laterally through the first elongate bar, and a bolt which extends through the bore of the first elongate bar and has a threaded distal end portion which is threadedly received in the threaded bore of the sealing element.

17. A fluid end apparatus for a reciprocating pump comprising:

a fluid end body having a bore which extends inwardly into a face of the fluid end body;

a closure slot which extends within the face of the fluid end body over an outer end of the bore;

the closure slot having a width dimension;

an outer access opening for the closure slot which extends inwardly to the closure slot from an outer surface of the face of the fluid end body, the outer access opening having a width dimension which is (i) less than the width dimension of the closure slot but (ii) the same as or greater than a diameter of the bore;

a closure plate structure having a first width dimension that is less than the width dimension of the access opening so that the closure plate structure can be placed in the closure slot through the access opening; and the closure plate structure having a second width dimension which is greater than the width dimension of the access opening but less than the width dimension of closure slot so that, after placing the closure plate structure in the closure slot through the access opening, the closure plate structure can be retained in the closure slot over the outer end of the bore by turning the closure plate structure less than a full turn in the closure slot.

18. The fluid end apparatus of claim 17 further comprising:

a non-threaded bore in the fluid end body which is positioned outside of the outer access opening and extends into the face of the fluid end body to the closure slot;

a threaded bore in the closure plate structure for alignment with the non-threaded bore in the fluid end body, and a bolt which extends through the non-threaded bore of the fluid end body and has a threaded distal end portion which is threadedly received in the threaded bore of the closure plate structure.

* * * * *